United States Patent [19]

Klem et al.

[11] 4,382,744

[45] May 10, 1983

[54] LOADER BELLCRANK MOUNTING MEANS

[75] Inventors: John E. Klem, Waukegan; Ezzat A. Hammoud, Libertyville; Daniel E. Nelson, Wildwood, all of Ill.

[73] Assignee: Dresser Industries, Inc., Dallas, Tex.

[21] Appl. No.: 246,462

[22] Filed: Mar. 23, 1981

[51] Int. Cl.[3] ..... E02F 3/00

[52] U.S. Cl. ..... 414/712; 403/154; 414/722

[58] Field of Search ..... 414/710, 712, 722, 727, 414/685; 403/154; 37/118 R, 80 R; 301/1, 117

[56] References Cited

U.S. PATENT DOCUMENTS

| | | | |
|---|---|---|---|
| 785,504 | 3/1905 | Le Sueur | 301/117 |
| 1,263,790 | 4/1918 | Moynihan | 414/722 |
| 2,216,070 | 9/1940 | Ekbom et al. | 414/720 |
| 2,986,292 | 5/1961 | Kampert et al. | 414/713 |
| 4,096,957 | 6/1978 | Iverson et al. | 403/154 X |

FOREIGN PATENT DOCUMENTS

| | | | |
|---|---|---|---|
| 642552 | 6/1962 | Canada | 414/722 |

*Primary Examiner*—Robert J. Spar
*Assistant Examiner*—Donald W. Underwood
*Attorney, Agent, or Firm*—J. N. Hazelwood; B. E. Deutsch

[57] ABSTRACT

A means for pivotally mounting the bellcrank of a bucket linkage between the boom arms of a loader, including pivot castings secured to each of the boom arms, a shaft extending through said pivot castings and the bellcrank, a plate secured to one end of the shaft and bolted to the adjacent pivot casting to prevent rotation of the shaft relative to the boom arms, and a second plate bolted to the other end of said shaft to limit inward axial movement of the shaft relative to the adjacent pivot casting.

2 Claims, 2 Drawing Figures

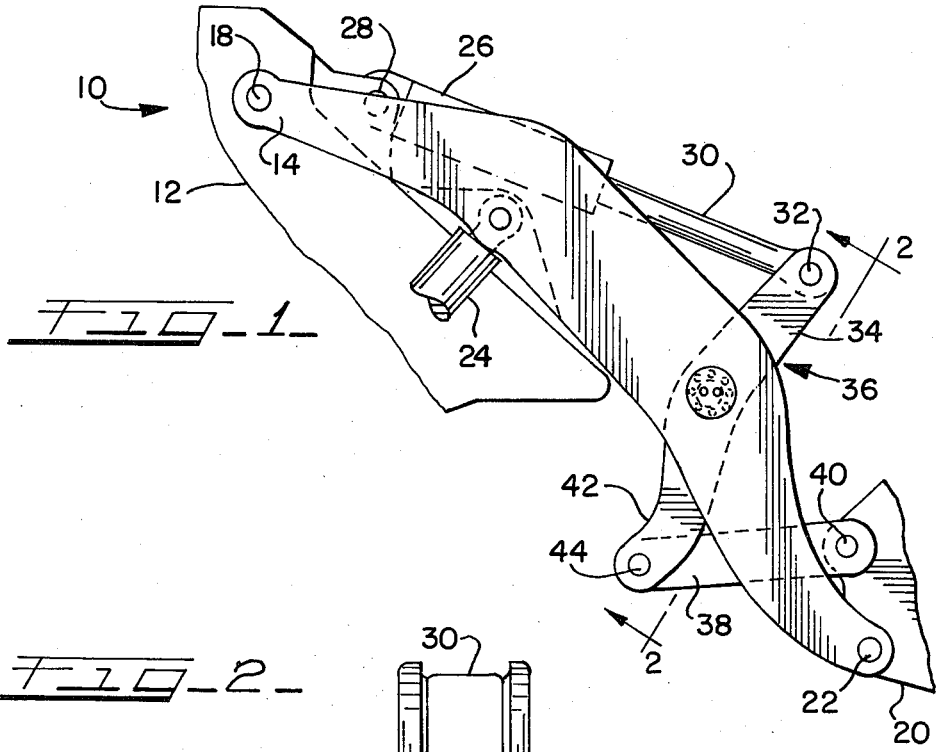
FIG. 1
FIG. 2
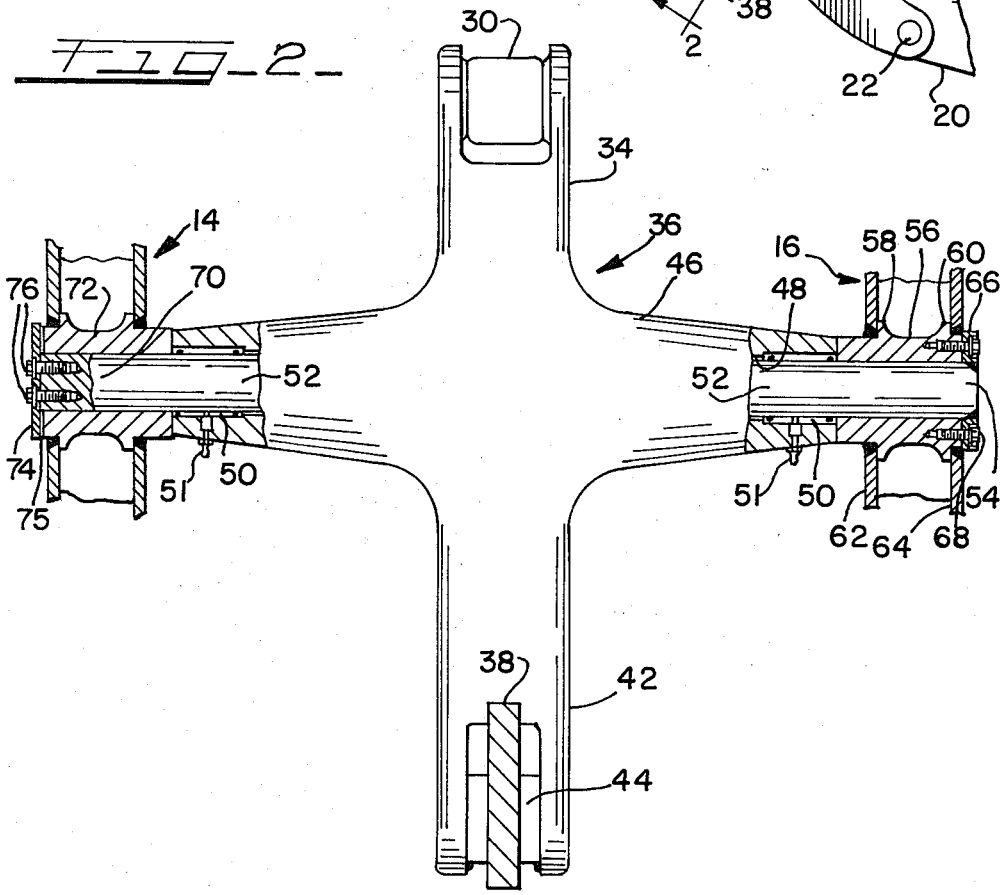

LOADER BELLCRANK MOUNTING MEANS

BACKGROUND AND SUMMARY OF THE INVENTION

The bellcrank of a bucket linkage is pivotally mounted on the boom arms of a loader, with a bucket cylinder pinned between the loader frame and the upper arm of the bellcrank and a link pinned between the lower arm of the bellcrank and the bucket. This arrangement, which is commonly called a "Z-bar linkage", is highly advantageous because it permits use of a single bucket cylinder, provides an inherent self-leveling feature for the bucket as the boom arms are raised, provides high breakout force, and permits mounting the head end of the cylinder adjacent the frame to simplify routing of the hydraulic connections to the bucket cylinder. However, such an arrangement requires mounting the bellcrank between the boom arms which introduces stresses, particularly in bending, on the shaft mounting the boom arms and which requires accommodating or preventing changes in the distance between the boom arm as the boom arms are elastically deflected under load, especially during digging operations in which the loader is driven forward and the bucket is rotated into the material. In addition, the boom arms are positioned to pivot on the loader frame so that, when lowered, each boom arm passes between the frame and the adjacent tire.

In the prior art, a boss was formed on each boom arm and the shaft mounting the boom arm was secured to the boom arm by means of a bolt passing through aligned holes in the boss and the shaft. When the bosses are formed on the inside edge of each boom arm, the holes extending through the shaft are located in a high stress area and act as a stress riser, thereby having a detrimental effect on the operational life of the shaft. When the bosses are formed on the outside edge of each boom arm, the holes are positioned in a lower stress area, but the boss extending outward significantly reduces the clearance between the boss and the tire when the boom arms are lowered, thereby restricting the type of tire mounted on the loader wheels and/or eliminating the use of chains on the tires when operating in adverse terrain or ground conditions.

It is, therefore, an object to provide a bellcrank mounting for a loader linkage which has improved operational life, which does not adversely affect tire clearance, and which is relatively simple to manufacture and maintain.

It is also an object of this invention to provide a bellcrank mounting which avoids creating stress risers and which permits use of chains on the tires when desired.

It is a further object of this invention to provide a bellcrank mounting which securely anchors the bellcrank pivot shaft and which accommodates lateral deflections of the boom arms without detrimental effect on the mounting.

These and other objects of the present invention, and many of the attendant advantages thereof, will become more readily apparent upon a perusal of the following description of a preferred embodiment of the invention and the accompanying drawings, wherein:

FIG. 1 is a side elevational view of a loader linkage incorporating the present invention; and FIG. 2 is a view taken on line 2—2 of FIG. 1.

DESCRIPTION OF A PREFERRED EMBODIMENT

Referring now to FIG. 1, there is shown a portion of a loader, indicated generally at 10, having a frame, a portion of which is shown at 12. A pair of boom arms 14 and 16 are pivotally attached to the frame 12 by pins 18 and a material handling implement, such as a bucket, a portion of which is shown at 20 is pivotally attached to the free ends of the boom arms 14 and 16 by pins 22. The boom arms 14 and 16 are raised and lowered by a pair of boom cylinders, one of which is shown at 24, each cylinder being pinned between a boom arm and the frame.

The bucket linkage, which is of the type commonly called "Z-bar linkage", is fully explained in U.S. Pat. No. 2,986,292 issued on May 30, 1961, to Kampert and Zimmerman. Basically, this linkage includes a bucket cylinder 26 having its head end pivotally attached to the frame 12 by pin 28 and its rod 30 pivotally attached by pin 32 to the upper arm 34 of the bellcrank 36. A link 38 is pivotally attached to the bucket 20 by pin 40 and to the lower arm 42 of the bellcrank 36 by pin 44. Retraction of the bucket cylinder 26 will cause the bucket to rotate about pin 22 toward its dump attitude and extension of this cylinder will cause the bucket to roll back.

Referring now to FIG. 2, the bellcrank 36 is provided with an integrally formed, central section 46 having a through bore 48. The ends of the bore 48 are counterbored to seat a bushing 50 which is suitably sealed to retain lubricant introduced through fitting 51. A shaft having a diameter smaller than the inner diameter of the bore 48 and compatible to the inner diameter of the bushings 50, extends through the central section 46 and beyond. The extension 54 of shaft 52 engages a bore in a pivot casting 56. The boom arms 14 and 16, as shown, are of the box-section type, but could be flat plate type. For box-section arms, the pivot casting 56 is provided with flanges 58 and 60 that engage the inner sides of the side plates 62 and 64 of the boom arm 16 and are secured to the side plates by welds. The flanges 58 and 60 serve both to help locate the casting 56 for the welding operation and maintain the integrity of the box-section under load. A plate 66 is secured to the outer end of extension 54 by weld and is secured to the casting 56 by bolts 68 passing through holes in the plate 66 and into tapped holes in the casting 56. This attachment prevents the shaft 52 from rotating relative to the casting 56 and the boom arm 16, thus assuring that rotation of the bellcrank 36 will be by the bushings 50 on the shaft 52. This attachment also restrains lateral movement of the shaft relative to the boom arm 16.

The extension 70 of the shaft 52 engages a bore in a pivot casting 72, which is essentially a mirror image of casting 56. The extension 70 projects slightly beyond the casting 56, when the boom arm 14 is in a relaxed or essentially unloaded condition. A plate 74 is secured to the flat end of the shaft 52 by bolts 76 passing through holes in the plate 74 and into tapped holes in the extension 70. This plate 74 prevents the shaft 52 from moving laterally inward relative to the casting 72, as may otherwise occur should the boom arm 14 bow outward under load. The clearance 75 between the inner surface of plate 74 and the flat, outer edge of extension 70 permits slight deflections of the boom arm 14, but permits the bolts 76 to draw the plate 74 against the flat end of extension 70 without introducing the possibility of drawing the boom arms toward each other. That is, this arrangement on the boom arm 14 permits holding the proper spacing between the boom arms and thereby avoids inhibiting free rotation of the bellcrank 36, as would occur if the central member 46 were squeezed between the inner ends of the castings 56 and 72.

It will be apparent from the foregoing that the shaft 52 has no openings through an outer fiber, which is where maximum unit stresses occur, and that the only openings in the shaft enter from the flat outer end of extension 70 and essentially on the outboard side of the boom arm. These holes are also in an end of the shaft 52 in which torsional stresses are essentially zero. The end 54 which does restrain all torsional loads in the shaft has no holes whatever, but instead has a plate 66 welded thereon to enhance its ability to restrain torsional loads. It will also be appreciated that the attachments of the plates 56 and 74 to the shaft 52 extends only a relatively small distance beyond the boom arms 14 and 16, so that the affect of the attachments on the clearance between tire and boom arm is minimized.

While one embodiment of the present invention has been disclosed herein, modifications and changes may be made therein without departing from the spirit of the invention, as defined by the scope of the following claims.

What is claimed is:

1. Apparatus for pivotally mounting a bellcrank to a loader linkage comprising:

a pair of parallelly disposed box-beam loader boom arms having a substantially fixed relative position, each having inner and outer side plates;

a pair of castings secured respectively between the side plates of each boom arm, each casting having a bore axially aligned with the bore in the other casting;

a bellcrank member having a central bore and extending between said boom arms;

a nonrotatable pivot shaft extending through said bellcrank bore and through said casting bores to the outer sides of both boom arms;

a first plate secured to a first end of said shaft adjacent the outer side of one boom arm, said first plate also being bolted to the casting thereat; and a second plate bolted to the second end of said shaft externally of the other boom arm, said second plate having a diameter larger than said shaft and being independent of said other boom arm such that the transmission of torsional loading between said one boom arm and said other boom arm through said shaft is prevented.

2. The invention in accordance with claim 1 and said second end of said shaft extending beyond the adjacent casting when said boom arms are in an unloaded condition sufficiently that drawing up said second plate against said second end of said shaft will not deflect the boom arms and bind said bellcrank therebetween.

* * * * *